US007490541B2

(12) United States Patent
Kawata et al.

(10) Patent No.: US 7,490,541 B2
(45) Date of Patent: Feb. 17, 2009

(54) COMPRESSOR

(75) Inventors: Takeshi Kawata, Shiga (JP); Kenji Watanabe, Shiga (JP); Kenji Okuzono, Shiga (JP); Nobunao Tsuchida, Shiga (JP)

(73) Assignee: Matsushita Electric Industrial, Co., Ltd., Kadoma-shi (JP)

( * ) Notice: Subject to any disclaimer, the term of this patent is extended or adjusted under 35 U.S.C. 154(b) by 184 days.

(21) Appl. No.: 10/482,170

(22) PCT Filed: Jul. 3, 2002

(86) PCT No.: PCT/JP02/06708

§ 371 (c)(1),
(2), (4) Date: Jan. 8, 2004

(87) PCT Pub. No.: WO03/006828

PCT Pub. Date: Jan. 23, 2003

(65) Prior Publication Data

US 2004/0170517 A1 Sep. 2, 2004

(30) Foreign Application Priority Data

Jul. 9, 2001 (JP) ..... 2001-207504

(51) Int. Cl.
*F01B 31/10* (2006.01)

(52) U.S. Cl. ..... 92/154

(58) Field of Classification Search ..... 92/154
See application file for complete search history.

(56) References Cited

U.S. PATENT DOCUMENTS

| | | | | |
|---|---|---|---|---|
| 4,279,578 | A | 7/1981 | Kim et al. | |
| 4,929,156 | A | 5/1990 | Eitai et al. | |
| 5,636,974 | A * | 6/1997 | Ikeda et al. | 92/154 |
| 6,152,713 | A * | 11/2000 | Hisanaga et al. | 418/55.2 |
| 6,481,240 | B2 * | 11/2002 | Strikis et al. | 417/313 |

FOREIGN PATENT DOCUMENTS

| | | |
|---|---|---|
| EP | 949465 A2 | 10/1999 |
| JP | 2-264189 | 10/1990 |
| JP | 11-82352 | 3/1999 |
| JP | 2002-242865 | 8/2002 |

* cited by examiner

*Primary Examiner*—F. Daniel Lopez
(74) *Attorney, Agent, or Firm*—Kratz, Quintos & Hanson, LLP.

(57) ABSTRACT

A compressor comprises a compressing mechanism which compresses fluid including a lubricant, a separation chamber into which the fluid compressed by the compressing mechanism is introduced and in which at least a portion of the lubricant included in the fluid is separated from the fluid, and an oil-storage chamber in which the lubricant separated from the fluid in the separation chamber is stored. An oil-introducing passage is formed between the separation chamber and the oil-storage chamber to bring these chambers into communication with each other, the oil-introducing passage introduces the lubricant separated in the separation chamber into the oil-storage chamber, an opening of the oil-introducing passage on the side of the oil-storage chamber is lower than an oil level of the lubricant stored in the oil-storage chamber in the vertical direction.

8 Claims, 5 Drawing Sheets

COMPRESSOR

TECHNICAL FIELD

The present invention relates to a compressor for compressing fluid, and more particularly, to a compressor used in an automobile air conditioning system.

BACKGROUND TECHNIQUE

A compressor especially used for an automobile air conditioning system discharges a portion of a compressor lubricant into a system cycle of the air conditioning system together with compressed fluid. As an amount of compressor lubricant discharged out together with fluid is increased, the system efficiency is more deteriorated.

In a compressor described in Japanese Patent Application Laid-open No.H11-82352, in order to restrain a lubricant from being discharged into the system cycle of the air conditioning system, a separation chamber for separating the lubricant from the compressed fluid is provided on a discharging side of a compressing mechanism.

At lower side (direction of gravity) of the separation chamber an oil-storage chamber which stores the lubricant separated from the fluid is formed. The separation chamber is formed with a discharge hole through which the lubricant separated by the separation chamber is discharged into the oil-storage chamber.

The separated lubricant is discharged from the discharge hole. In order to prevent the discharged lubricant from colliding directly against an oil level of the oil-storage chamber, the discharge hole is opened in the horizontal direction or a collision wall against which the lubricant discharged from the discharge hole collides is formed such as to be opposed to an opening of the discharge hole.

In order to restrain the oil level of the oil-storage chamber from being varied, the compressor described in this publication employs a structure that fluid discharged from the compressing mechanism is prevented from colliding directly against the oil level. That is, the separation chamber is disposed at a location vertically upwardly away from the oil level of the oil-storage chamber.

However, in order to separate the separation chamber from the oil level of the oil-storage chamber, a space must be secured between the oil level and an oil-discharge hole of the oil-storage chamber. Therefore, the outside dimension of the compressor in the vertical direction is adversely increased due to this space.

To help solve this problem, this publication also discloses that the separation chamber is inclined with respect to a vertical reference line of the compressor.

By employing this structure, the dimension of the separation chamber in the vertical direction is slightly reduced. However, according to this conventional structure, basically, only a portion of the space of the oil-storage chamber below the separation chamber can be utilized as an oil-storage space, and there exist many wasted spaces.

Hence, in view of the above-described conventional problems, it is an object of the present invention to provide a compressor which is smaller than conventional compressors by effectively using the space of the oil-storage chamber.

DISCLOSURE OF THE INVENTION

To achieve the above object, in the compressor of the present invention, an oil-introducing passage introduces a lubricant separated in the separation chamber into an oil-storage chamber. An opening of the oil-introducing passage on the side of the oil-storage chamber is lower than an oil level of a lubricant stored in the oil-storage chamber in the vertical direction.

With this structure, a space which isolates the separation chamber and the oil-storage chamber is eliminated. Correspondingly, it is possible to reduce the outer dimension of the compressor in the vertical direction. A pressure of fluid discharged from the compressing mechanism is applied to the lubricant in the oil-storage chamber from the separation chamber, and the lubricant in the oil-storage chamber is pushed up. Thus, the upper space in the oil-storage chamber which was a wasted space in the conventional compressor can effectively be utilized as the oil-storage space.

Further, a communication passage which allows the fluid to flow between the oil-storage chamber and the separation chamber is provided between an upper portion in the oil-storage chamber and the separation chamber. When the lubricant in the oil-storage chamber is pushed up, the communication passage function as a vent of gas and fluid such as refrigerant gas stored in the upper portion of the oil-storage chamber. Thus, it is possible to restrain the gas and fluid stored in the upper portion of the oil-storage chamber from preventing the pushing up of the lubricant.

A portion of the oil-introducing passage is narrowed, i.e., a cross-sectional area of the portion of the oil-introducing passage is reduced. With this, the variation in oil level in the oil-storage chamber which may be caused by pressure variation of fluid discharged from the compressing mechanism is restrained by the viscosity resistance of the lubricant which passes through the narrow portion the oil-introducing passage.

PREFERRED EMBODIMENTS OF THE PRESENT INVENTION

Embodiments of the present invention will be explained based on examples of a so-called vane rotary type compressor with reference to the drawings.

Embodiment 1

Figure 1:
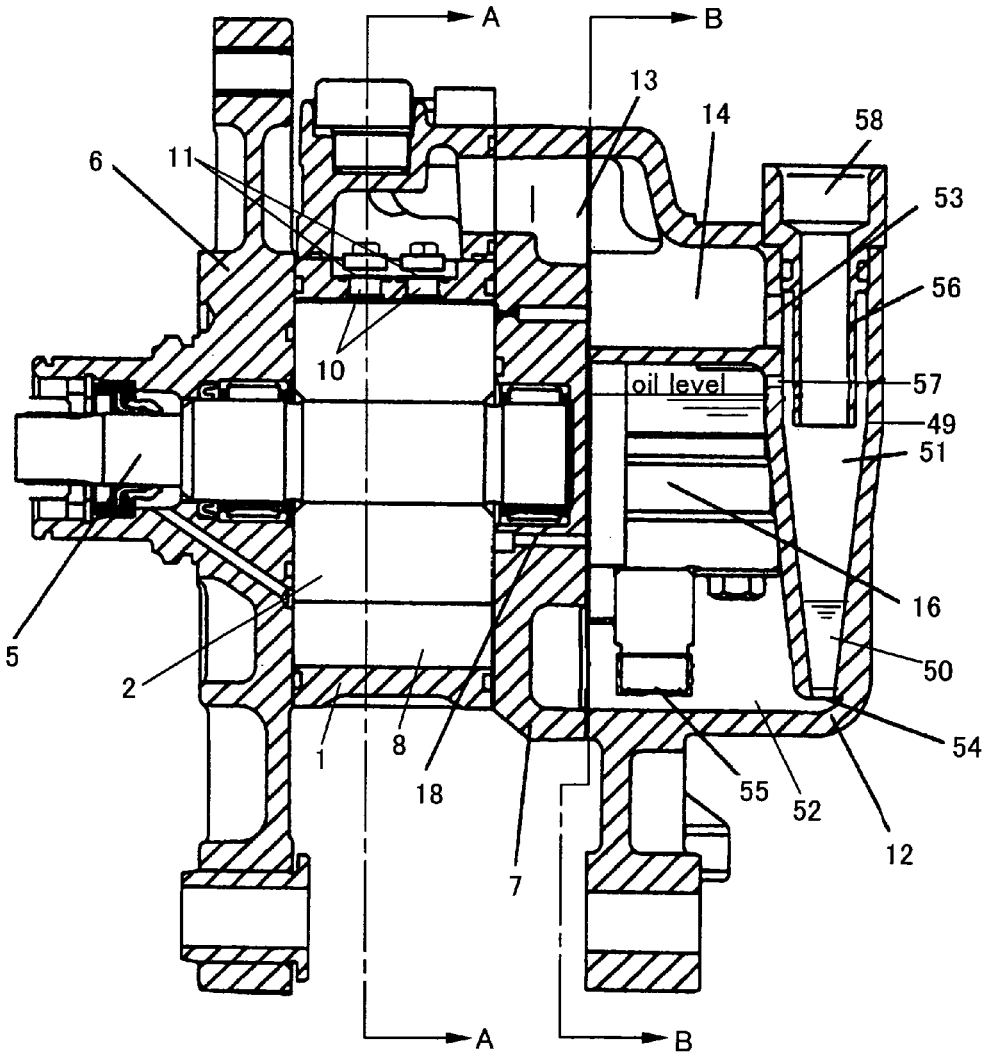
FIG. 1 is a transverse sectional view showing an embodiment 1 of the present invention.
Figure 2:
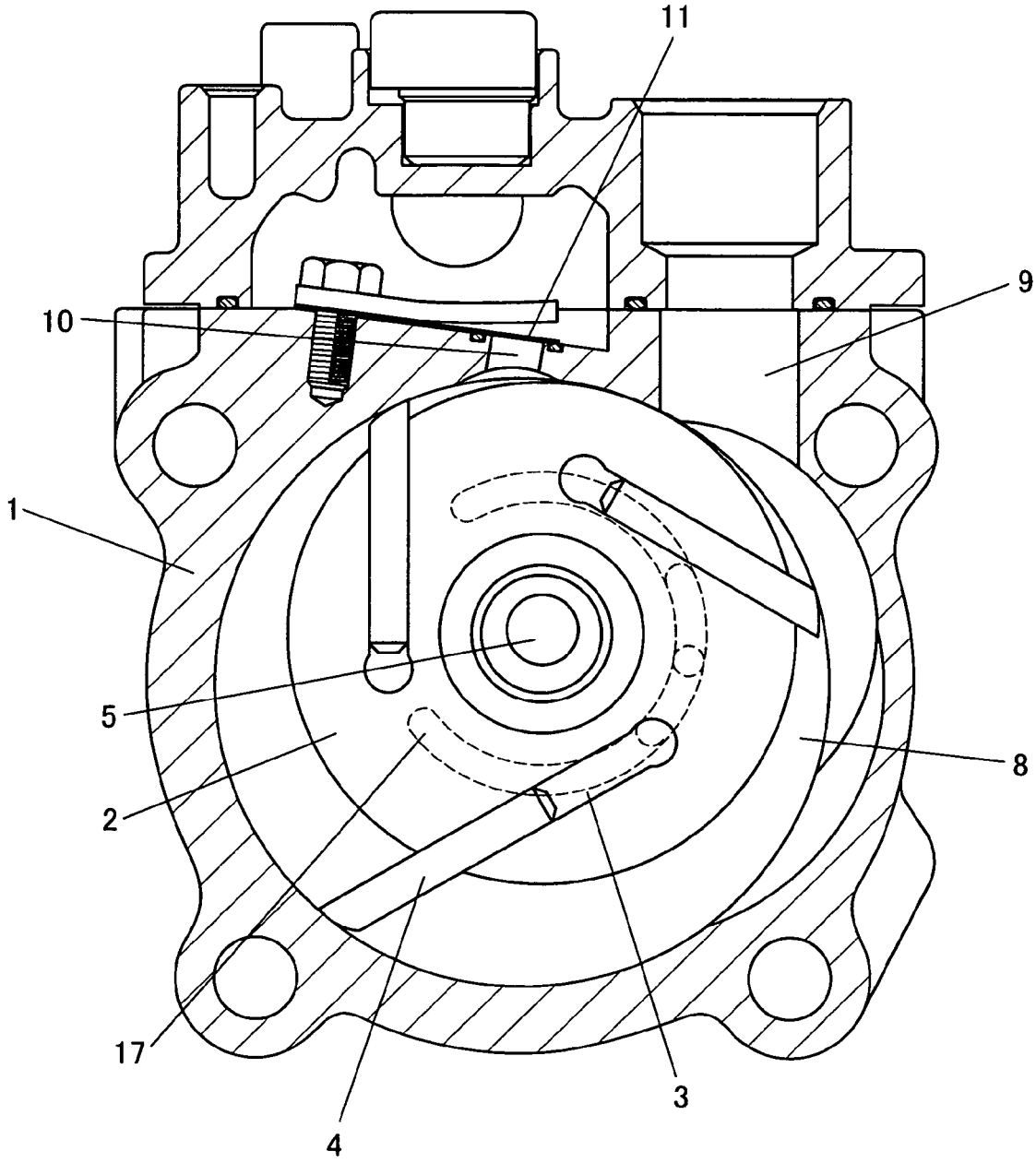
FIG. 2 is a sectional view of an operation chamber of the compressor taken along a line A-A in FIG. 1.
Figure 3:
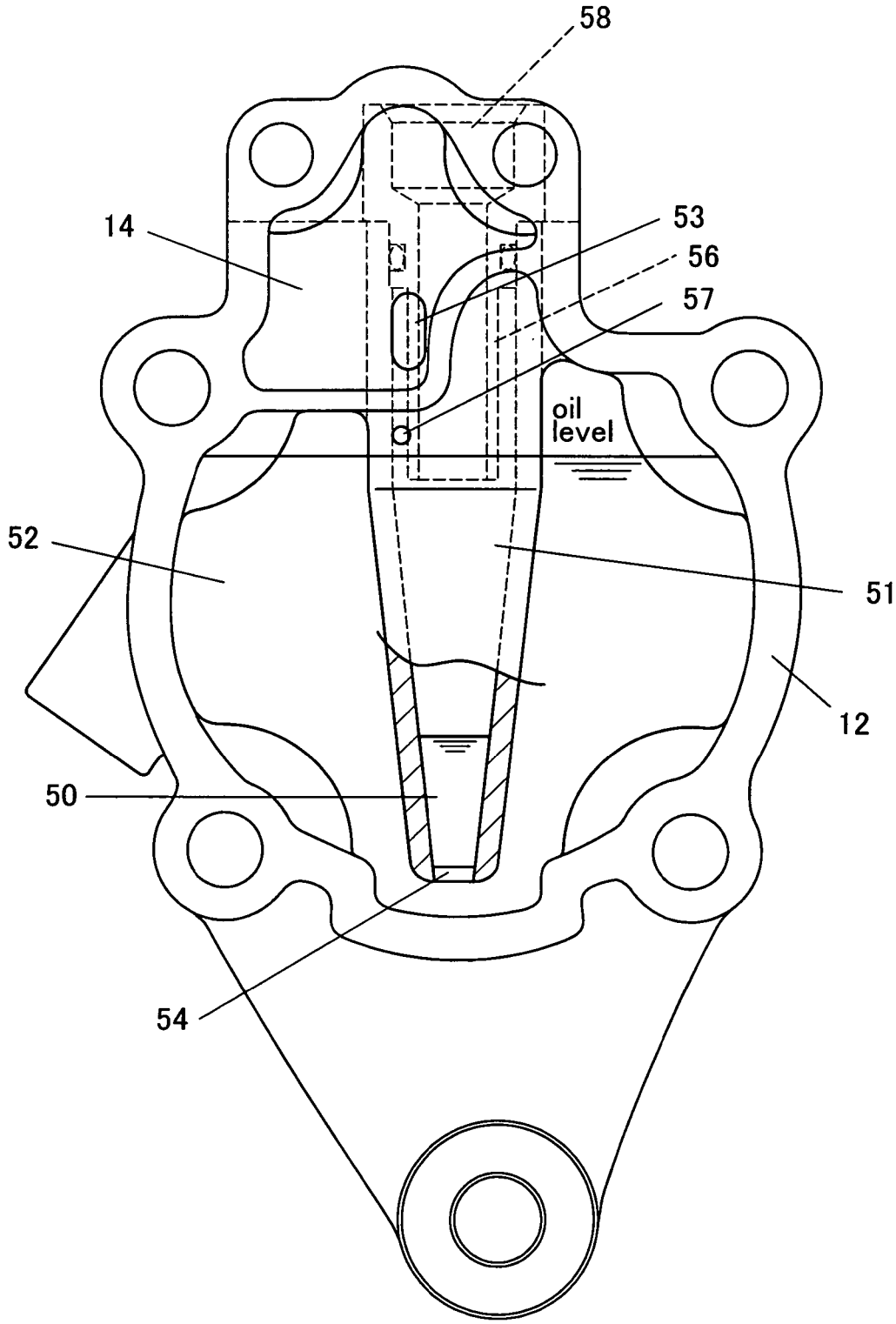
FIG. 3 is a view of a high pressure case of the compressor as viewed from the operation chamber.

FIGS. 1 to 3 show an embodiment 1 of a compressor of the present invention. As shown in FIGS. 1 to 3, in this compressor, a substantially columnar rotor 2 is rotatably accommodated in a cylinder 1 having a cylindrical inner wall such that a fine gap is formed between a portion of an outer periphery of the rotor 2 and the inner wall of the cylinder 1.

The rotor 2 is provided with a plurality of vane slots 3 arranged at equal distances from one another. Vanes 4 are slidably inserted into the vane slots 3, respectively. The rotor 2 is integrally formed with a driving shaft 5, and if the driving shaft 5 is rotated and driven, the rotor 2 is rotated.

Opposite openings of the cylinder 1 are closed with a front plate 6 and a rear plate 7, respectively. An operation chamber 8 is formed in the cylinder 1. A suction port 9 and discharge ports 10 are in communication with the operation chamber 8. The discharge ports 10 are connected to a high pressure passage 13, and discharge valves 11 are disposed between the discharge ports 10 and the high pressure passage 13. A high pressure case 12 is mounted to the rear plate 7. A high pressure chamber 14, a separation chamber 51 and an oil-storage chamber 52 are formed in the high pressure case 12.

The high pressure chamber 14 is in communication with the separation chamber 51 through an introducing hole 53. A lubricant is included in compressed high pressure fluid. The separation chamber 51 is provided for separating the lubricant from the high pressure fluid. An oil-introducing passage 50 is provided in a partition wall which separates the separation chamber 51 and the oil-storage chamber 52 from each other. The separation chamber 51 is in communication with the oil-storage chamber 52 through the oil-introducing passage 50.

The lubricant stored in the oil-storage chamber 52 is supplied, through the oil-supply passage 18, to the rotor 2, the vane 4, the inner wall of the cylinder and the like which constitute a compressing mechanism, and lubricates these elements, and is supplied to the vane back pressure chamber 17 and pushes the vane 4 out from the rotor 2 by a pressure of the vane back pressure chamber 17.

The lubricant is supplied through the oil-supply passage 18 which supplies the lubricant from the oil-storage chamber 52 to the compressing mechanism. The oil-supply passage 18 is provided at its intermediate portion with a vane back pressure adjusting apparatus 16. The vane back pressure adjusting apparatus 16 controls the oil-supply pressure and the oil-supply amount of lubricant to be supplied to the compressing mechanism in accordance with a pressure of fluid (refrigerant) around the compressing mechanism.

If power is transmitted to the driving shaft 5 and the rotor 2 from a driving source such as an engine and the driving shaft 5 and the rotor 2 are rotated in the clockwise direction in FIG. 2, low pressure fluid (refrigerant) flows into the operation chamber 8 from the suction port 9. High pressure fluid which was compressed by rotation of the rotor 2 pushes the discharge valve 11 upward from the discharge port 10 and is discharged into the high pressure passage 13 and flows into the high pressure chamber 14.

The high pressure fluid flows into the separation chamber 51 from the introducing hole 53, and lubricant included in the high pressure fluid is separated in the separation chamber 51.

The separation chamber 51 has a structure of a so-called centrifugal oil separator. More specifically, in the separation chamber 51, a cylindrical discharge pipe 56 is disposed substantially in the vertical direction, and a cylindrical space is concentrically provided around an outer periphery of the discharge pipe 56.

The introducing hole 53 introduces the high pressure fluid into the cylindrical space. It is preferable that the introducing hole 53 is formed such that the hole introduces the high pressure fluid in a tangent direction of the cylindrical space, i.e., the compressed fluid is discharged along the outer peripheral surface (inner peripheral surface of the cylindrical portion of the high pressure case 12 which forms the cylindrical space) 49 of the cylindrical space.

A reason why the introducing hole 53 is formed such as to discharge the compressed fluid along the outer peripheral surface 49 of the cylindrical space is that the high pressure fluid is allowed to turn in the cylindrical space more smoothly. The high pressure fluid flows downward to a lower end opening of the discharge pipe 56 while turning in the cylindrical space, passes through the discharge pipe 56 from the lower end opening and is discharged out from the compressor through the gas discharge opening 58.

While the lubricant included in the high pressure fluid turns in the cylindrical space, the lubricant comes into contact with the outer peripheral surface (inner peripheral surface of the cylindrical portion of the high pressure case 12 which forms the cylindrical space) 49 of the cylindrical space by a centrifugal force, and the lubricant is separated from the refrigerant gas. The separated lubricant moves downward along the inner peripheral surface of the cylindrical portion of the high pressure case 12 which forms the cylindrical space. In the embodiment 1, the cylindrical space is formed at its lower portion with a substantially reversed conical space. The separation chamber 51 is mainly constituted by this substantially reversed conical space and the cylindrical space described above.

A lower end of the separation chamber 51 is formed with the oil-introducing passage 50 which introduces the separated lubricant into the oil-storage chamber 52.

As shown in FIG. 1, the oil-introducing passage 50 is formed such as to extend vertically downward. An opening 54 of the oil-introducing passage 50 on the side of the oil-storage chamber opens in a lubricant below the oil level of lubricant stored in the oil-storage chamber 52 in the vertical direction. Therefore, in the embodiment 1 of this invention, the separated lubricant is also stored in the lower portion of the separation chamber 51 or the oil-introducing passage 50 more or less.

In order to allow the opening 54 of the oil-introducing passage 50 on the side of the oil-storage chamber to open in the lubricant below the oil level of the lubricant in the oil-storage chamber 52, it is necessary to previously adjust an initial amount of lubricant to be injected.

As described above, the lubricant stored in the oil-storage chamber 52 is supplied to the vane back pressure chamber 17 of the compressing mechanism through the vane back pressure adjusting apparatus 16. The lubricant is supplied through the opening 55 of the oil-supply passage 18, on the side of the oil-storage chamber, which supplies the lubricant from the oil-storage chamber 52 to the compressing mechanism. It is preferable that a height of the opening 55 is equal to or higher than a height of the opening 54 of the oil-introducing passage 50 on the side of the oil-storage chamber in the vertical direction.

With this structure, the opening 54 of the oil-introducing passage 50 on the side of the oil-storage chamber can always open in the lubricant in the oil-storage chamber 52.

In the case of the compressor of the present invention, a pressure of the high pressure fluid discharged from the compressing mechanism is applied such as to push up the lubricant level in the oil-storage chamber 52 from the separation chamber 51. However, when the lubricant in the oil-storage chamber 52 is pushed up, it is considered that fluid and gas stored in an upper portion of the oil-storage chamber 52 prevent the lubricant from being pushed up.

In the embodiment 1 of the present invention, a communication passage 57 is provided between the upper portion of the oil-storage chamber 52 and the separation chamber 51. The communication passage 57 allows fluid to flow between the oil-storage chamber 52 and the separation chamber 51. The communication passage 57 functions as a vent of gas and fluid such as refrigerant gas stored in the upper portion of the oil-storage chamber 52. Therefore, the lubricant in the oil-storage chamber 52 can be push up smoothly.

Like the introducing hole 53 which introduces the high pressure fluid into the separation chamber 51, it is preferable that the communication passage 57 is formed such as to introduce the fluid from the oil-storage chamber 52 into the separation chamber 51 along an outer peripheral surface (inner peripheral surface of the cylindrical portion of the high pressure case 12 which forms the cylindrical space) 49 of the cylindrical space of the separation chamber 51.

With this structure, since a negative pressure is generated in the communication passage 57, fluid can smoothly flow from the upper portion of the oil-storage chamber 52 into the separation chamber 51. When the generated negative pressure is great, the rising of the oil level in the oil-storage chamber 52 is facilitated.

When the lubricant in the oil-storage chamber 52 reaches the communication passage 57 for any reason, the lubricant reaches the separation chamber 51 through the communication passage 57, but immediately after the lubricant reaches the separation chamber 51, the lubricant flows along the outer peripheral surface (inner peripheral surface of the cylindrical portion of the high pressure case 12 which forms the cylindrical space) 49 of the cylindrical space of the separation chamber 51, and the lubricant is collected or recycled before long.

In the embodiment 1 of the present invention, as apparent from the drawings also, a cross-sectional area of the oil-introducing passage 50 is smaller than cross-sectional area of the separation chamber 51 and the oil-storage chamber 52, and the entire oil-introducing passage 50 functions as a narrow portion for generating a flowing resistance of the lubricant.

It is preferable that a cross-sectional area and a length of the narrow portion are suitably determined in accordance with the viscosity of lubricant to be used. The oil level of the lubricant stored in the oil-storage chamber 52 or the lower portion of the separation chamber 51 is abruptly varied by influence of pressure variation of the high pressure fluid which is discharged from the compressing mechanism. However, with the above structure, it is possible to restrain the oil level from being abruptly varied utilizing the viscosity resistance of the lubricant which passes through the oil-introducing passage 50.

Since the oil level variation is restrained, the oil level is not lowered than the position of the opening 55 of the oil-supply passage 18 which supplies the lubricant from the oil-storage chamber 52 to the compressing mechanism, and it is possible to stably supply the lubricant to the compressing mechanism.

According to the compressor having the above-described structure, the opening 54 of the oil-introducing passage 50 on the side of the oil-storage chamber opens in the lubricant stored in the oil-storage chamber 52. Therefore, unlike the conventional compressor, it is unnecessary to secure a space between the separation chamber 51 and the oil-storage chamber 52, and the upper space of the oil-storage chamber 52 which was a wasted space in the conventional compressor can effectively be utilized as the oil-storage space. Thus, it is possible to provide a compressor smaller than the conventional compressor.

Embodiment 2

Figure 4:
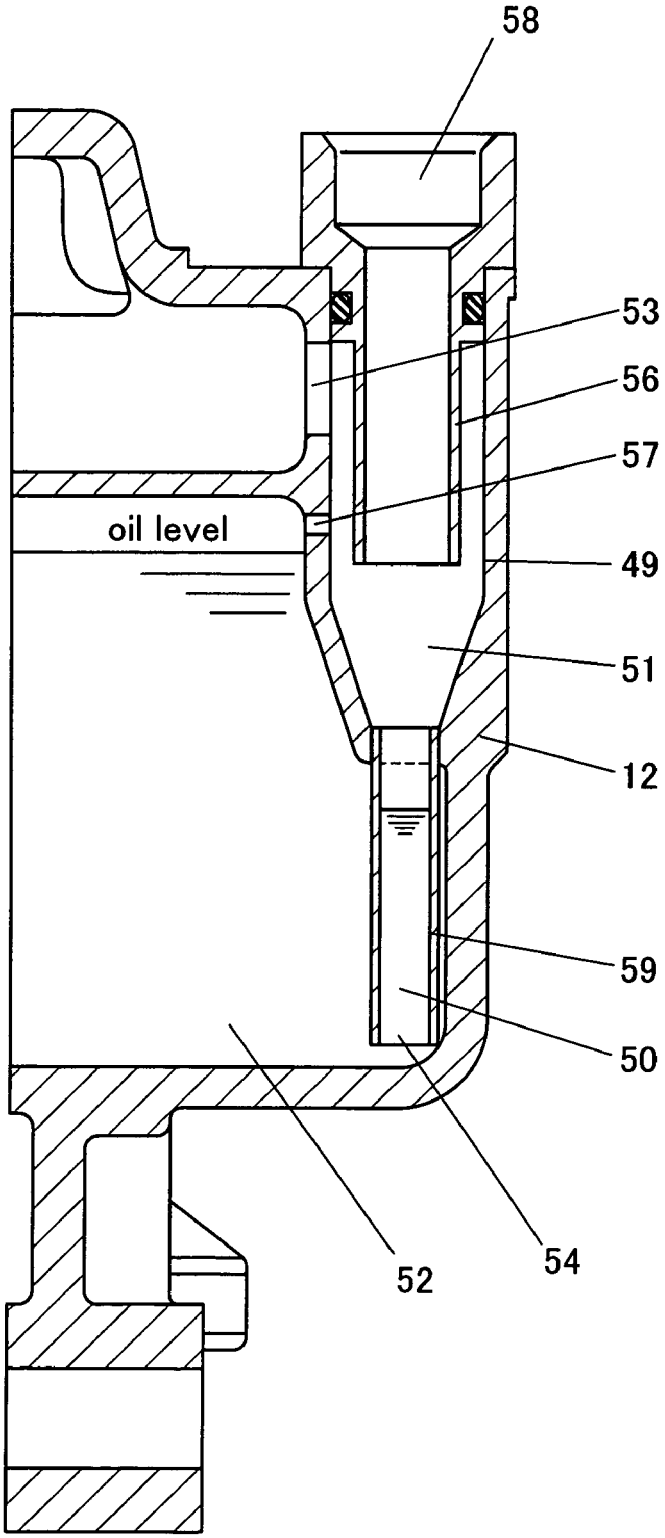
FIG. 4 is a sectional view of a high pressure case according to an embodiment 2 of the invention.

In an embodiment 2, as shown in FIG. 4, a lower portion of the separation chamber 51 is shortened as compared with the embodiment 1, one end of a pipe 59 is connected to the lower portion of the separation chamber 51, and the other end of the pipe 59 is opened in the lubricant below the lubricant level in the oil-storage chamber 52 in the vertical direction. Other portions are the same as those of the embodiment 1 and thus, explanation thereof will be omitted.

The embodiment 2 can exhibit the same effects as those of the embodiment 1. Especially in this structure, if the pipe 59 can be bent, the pipe 59 can open at any position in the lubricant, and the flexibility in layout of the structure of the compressor is enhanced. Shape and material of the pipe 59 are not especially limited.

In this embodiment 2, a cross-sectional area of the pipe 59 is smaller than cross-sectional area of the separation chamber 51 and the oil-storage chamber 52, and the entire pipe 59 is a narrow portion which increases the flowing resistance of the lubricant. The entire pipe 59 functions as the narrow portion.

Embodiment 3

Figure 5:
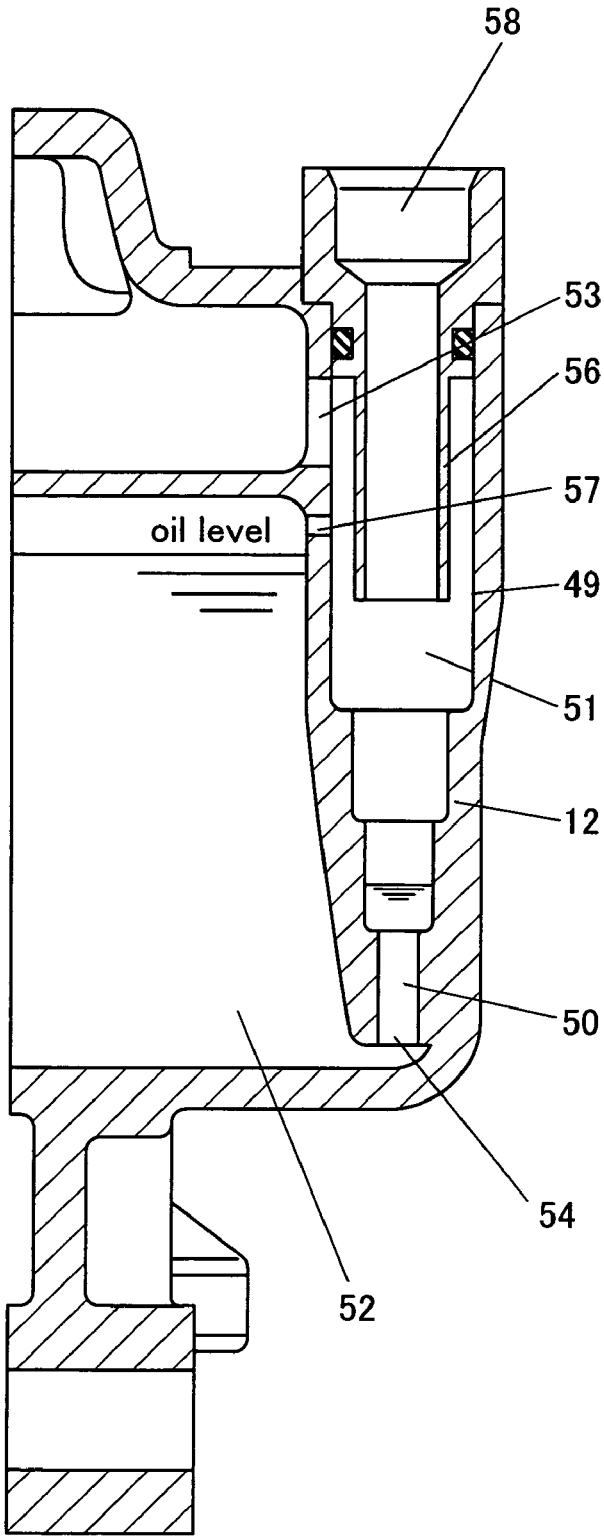
FIG. 5 is a sectional view of a high pressure case according to an embodiment 3 of the invention.

In the embodiment 1, the lower space of the separation chamber 51 is of the substantially reversed conical shape. In the embodiment 3, as shown in FIG. 5, the lower space of the separation chamber 51 is tapered in stages. Other portions of the embodiment 3 are the same as those and thus, explanation thereof will be omitted.

The embodiment 3 can exhibit the same effects as those of the embodiment 1.

In the embodiments 1 to 3, the sliding vane type rotary compressing mechanisms have been explained as the compressing mechanism, but the present invention is not limited to this, and it is possible to employ other compressing mechanisms such as a rolling piston type compressing mechanism, a scroll type compressing mechanism and the like.

Although the so-called turning (centrifugal) type separating mechanisms have been explained as the separating mechanism of lubricant, but it is possible to employ other separating mechanisms such as a colliding type separating mechanism, a filtering type separating mechanism and the like.

As explained above, in the compressor of the present invention, the opening of the oil-introducing passage on the side of the oil-storage chamber which introduces the lubricant separated in the separation chamber into the oil-storage chamber is located below the lubricant level stored in the oil-storage chamber in the vertical direction. Thus, the space which isolates the separation chamber and the oil-storage chamber is eliminated. Correspondingly, it is possible to reduce the outer dimension of the compressor in the vertical direction.

The fluid pressure discharged from the compressing mechanism is applied to the lubricant in the oil-storage chamber from the separation chamber, and pushes up the lubricant in the oil-storage chamber. Thus, the upper space in the oil-storage chamber which was a wasted space in the conventional compressor can effectively be utilized as the oil-storage space. Thus, it is possible to provide a compressor smaller than the conventional compressor.

The communication passage is provided between the upper portion of the oil-storage chamber and the separation chamber. The communication passage allows fluid to flow between the oil-storage chamber and the separation chamber. Thus, when the lubricant in the oil-storage chamber is pushed up, the communication passage functions as a vent of gas and fluid such as refrigerant gas stored in the upper portion of the oil-storage chamber.

Therefore, the gas and fluid stored in the upper portion of the oil-storage chamber are prevented from hindering the rising of the lubricant level, the lubricant level is smoothly risen, and the upper space in the oil-storage chamber which was a wasted space in the conventional compressor can effectively be utilized as the oil-storage space.

The cross-sectional area of at least a portion of the oil-introducing passage is reduced. With this structure, it is possible to restrain the oil level in the oil-storage chamber from being varied which may be caused by pressure variation of fluid which is discharged from the compressing mechanism due to the flowing resistance of lubricant which passes through the introducing passage.

What is claimed is:

1. A compressor comprising a compressing mechanism which compresses fluid including a lubricant, a separation chamber into which the fluid compressed by said compressing mechanism is introduced by an introducing hole and in which at least a portion of the lubricant included in the fluid is separated from the fluid, an oil-storage chamber in which the lubricant separated from the fluid in said separation chamber is stored, and a communication passage having a cylindrical shape being provided between said separation chamber and an upper portion of said oil-storage chamber, wherein an oil-introducing passage is formed between said separation chamber and said oil-storage chamber to bring these chambers into communication with each other, said oil-introducing passage is formed such as to extend vertically downward from said separation chamber, a cross-sectional area of said oil-introducing passage is smaller than cross-sectional area of said separation chamber, and an opening of said oil-introducing passage on the side of said oil-storage chamber opens at a lower end of said oil-introducing passage, said oil-introducing passage introduces the lubricant separated in said separation chamber into said oil-storage chamber, an opening of said oil-introducing passage on the side of said oil-storage chamber is lower than an oil level of the lubricant stored in said oil-storage chamber in the vertical direction, said separation chamber having a smooth cylindrical interior space without protrusions, the introducing hole is formed such that said fluid is discharged along the outer peripheral surface of said cylindrical space, said oil-introducing passage having a conical space, wherein the introducing hole, the communication passage, and the opening are spaced apart from each other.

2. The compressor according to claim 1, wherein the communication passage is spaced apart from the introducing hole by a partition wall.

3. The compressor according to claim 2, wherein at least a portion of said oil-introducing passage is formed with a narrow portion.

4. The compressor according to claim 3, wherein an oil-supply passage which supplies the stored lubricant to said compressing mechanism is in communication with said oil-storage chamber, a height of an opening of said oil-supply passage on the side of said oil-storage chamber is equal to or higher than a height of the opening of said oil-introducing passage on the side of the oil-storage chamber in the vertical direction.

5. The compressor according to claim 2, wherein an oil-supply passage which supplies the stored lubricant to said compressing mechanism is in communication with said oil-storage chamber, a height of an opening of said oil-supply passage on the side of said oil-storage chamber is equal to or higher than a height of the opening of said oil-introducing passage on the side of the oil-storage chamber in the vertical direction.

6. The compressor according to claim 1, wherein at least a portion of said oil-introducing passage is formed with a narrow portion.

7. The compressor according to claim 6, wherein an oil-supply passage which supplies the stored lubricant to said compressing mechanism is in communication with said oil-storage chamber, a height of an opening of said oil-supply passage on the side of said oil-storage chamber is equal to or higher than a height of the opening of said oil-introducing passage on the side of the oil-storage chamber in the vertical direction.

8. The compressor according to claim 1, wherein an oil-supply passage which supplies the stored lubricant to said compressing mechanism is in communication with said oil-storage chamber, a height of an opening of said oil-supply passage on the side of said oil-storage chamber is equal to or higher than a height of the opening of said oil-introducing passage on the side of the oil-storage chamber in the vertical direction.

* * * * *